US008438855B2

(12) United States Patent
Schott

(10) Patent No.: US 8,438,855 B2
(45) Date of Patent: May 14, 2013

(54) SLOTTED COMPRESSOR DIFFUSER AND RELATED METHOD

(75) Inventor: Carl G. Schott, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1047 days.

(21) Appl. No.: 12/219,625

(22) Filed: Jul. 24, 2008

(65) Prior Publication Data

US 2010/0021293 A1 Jan. 28, 2010

(51) Int. Cl.
*F04D 29/54* (2006.01)

(52) U.S. Cl.
USPC ..... 60/751; 60/760; 60/772; 415/211.2; 415/190; 415/208.1; 415/208.2

(58) Field of Classification Search ..... 60/39.37, 60/751, 752–760, 772; 415/1, 207, 209.2, 415/209.3, 209.4, 211.2, 189, 190, 208.1, 415/208.2
See application file for complete search history.

(56) References Cited

U.S. PATENT DOCUMENTS 2,541,170 A * 2/1951 Mayers et al. ..... 60/751
3,963,369 A 6/1976 Balje
4,100,732 A 7/1978 Bryans et al.
4,338,063 A 7/1982 Nakanishi
4,458,479 A 7/1984 Reider et al.
5,592,821 A * 1/1997 Alary et al. ..... 60/751
5,697,209 A * 12/1997 Wettstein ..... 60/39.53
6,168,375 B1 1/2001 LaRue et al.
6,334,295 B1 1/2002 Eldrid et al.
6,513,330 B1 2/2003 Rice et al.
6,672,070 B2 * 1/2004 Bland et al. ..... 60/772
6,843,059 B2 1/2005 Burrus et al.
7,101,151 B2 9/2006 Loringer et al.

FOREIGN PATENT DOCUMENTS

CN 1392331 A 1/2003
CN 1745253 A 3/2006

OTHER PUBLICATIONS

Search Report and Written Opinion from CN Application No. 200910164931.4 dated Nov. 6, 2012.

* cited by examiner

*Primary Examiner* — Ehud Gartenberg
*Assistant Examiner* — Steven Sutherland
(74) *Attorney, Agent, or Firm* — Nixon & Vanderhye, P.C.

(57) ABSTRACT

A compressor diffuser for a gas turbine includes: a compressor diffuser having an upstream end and a downstream end, the downstream end defined by a peripheral annular edge, the annular edge formed with a plurality of substantially axially-oriented slots extending from an opening at the downstream edge in an upstream direction.

18 Claims, 5 Drawing Sheets

SLOTTED COMPRESSOR DIFFUSER AND RELATED METHOD

This invention relates generally to gas turbine combustion technology and, more specifically, to modifications in the compressor diffuser to reduce aerodynamic loss associated with the compressor discharge casing of some industrial gas turbines.

BACKGROUND OF THE INVENTION

An aerodynamic loss has been identified with the compressor discharge casing of some industrial gas turbines. The loss is produced by reacceleration of compressor discharge flow in narrowed areas or "pinch points" just downstream of the compressor diffuser, and it causes increased fuel consumption and reduced cooling of some combustion parts. Generally, newer turbine designs with multi-passage radial discharge diffusers or with redesigned flow sleeves, liners, etc. are not feasible for existing gas turbines because of high development and installation costs.

There remains a need, therefore, for a relatively low-cost solution suitable for field modification.

BRIEF DESCRIPTION OF THE INVENTION

In accordance with an exemplary but non-limiting implementation of this invention, there is provided a compressor diffuser for a gas turbine comprising an upstream end and a downstream end, the downstream end defined by a peripheral annular edge, the annular edge formed with a plurality of substantially axially-oriented slots extending from an opening at the annular edge in an upstream direction.

In another exemplary but non-limiting implementation, the invention relates to a gas turbine comprising a compressor, an annular array of combustor cans arranged to supply combustion gases to a first stage of the turbine in a first direction, wherein the compressor includes a diffuser shaped to direct compressor discharge air in a second opposite direction to an aft end of the combustor cans for use in combustion; the diffuser having an upstream end and a downstream end formed with a plurality of substantially axially-oriented slots.

In yet another exemplary but non-limiting implementation, the invention relates to a gas turbine comprising a compressor, an annular array of combustor cans arranged to supply combustion gases to a first stage of the turbine in a first direction, wherein the compressor includes a diffuser shaped to direct compressor discharge air in a second opposite direction to an aft end of the combustor cans for use in combustion; the diffuser having an upstream end and a downstream end; and means located at the downstream end for enhancing reversal of compressor discharge air from the first direction to the second direction.

In still another exemplary implementation, the invention relates to a method for enhancing air flow reversal in a gas turbine combustion system where compressor discharge air is reverse-flowed to a combustor comprising: forming a compressor diffuser with a plurality of substantially axially-oriented slots extending from a downstream end of the diffuser in an upstream direction; and associating at least one flow direction vane with one or more of the substantially axially-oriented slots.

The invention will now be described in connection with the drawings identified below.

DETAILED DESCRIPTION OF THE INVENTION

Figure 1:
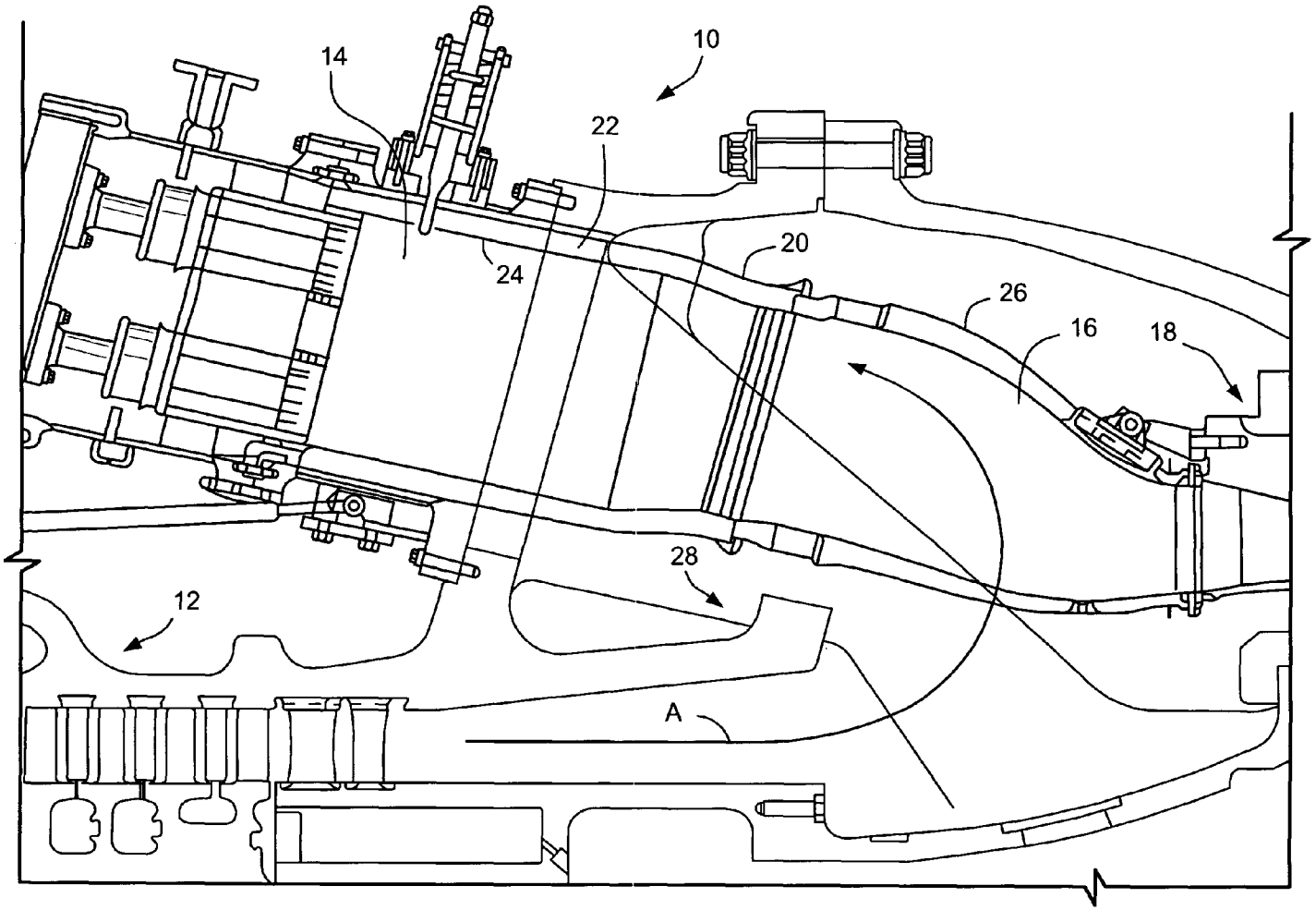
FIG. 1 is a partial cross section of a conventional gas turbine compressor and combustor.

With initial reference to FIG. 1, a can-annular reverse-flow combustor 10 is illustrated. The combustor 10, along with several other similar combustors (or combustor cans), are arranged in an annular array about the turbine rotor, and generate the gases needed to drive the turbine wheels in the various turbine stages. In operation, discharge air from compressor 12, indicated by flow arrow A, flows through the diffuser 28 and reverses direction as it passes over the outside of the combustor 10 and then reverses direction again as it enters the forward ends of the combustors. Combustion air and fuel are burned in the combustion chambers 14 (one shown), producing high-temperature gases that flow through a transition duct 16 to the first turbine stage indicated at 18.

On its way to the combustor 10, the compressor discharge air flows through a flow sleeve 20 which forms an annular gap or passage 22 radially between the flow sleeve 20 and the combustor liner 24. A similar flow sleeve 26 surrounds the transition duct 16 and joins with the flow sleeve 20 at the interface between the liner 24 and the transition duct 16. It will be understood that discharge air flows into the gap 22 by way of arrays of holes in the flow sleeves (not shown). To this point, the turbine combustor arrangement is of conventional design.

Figure 2:
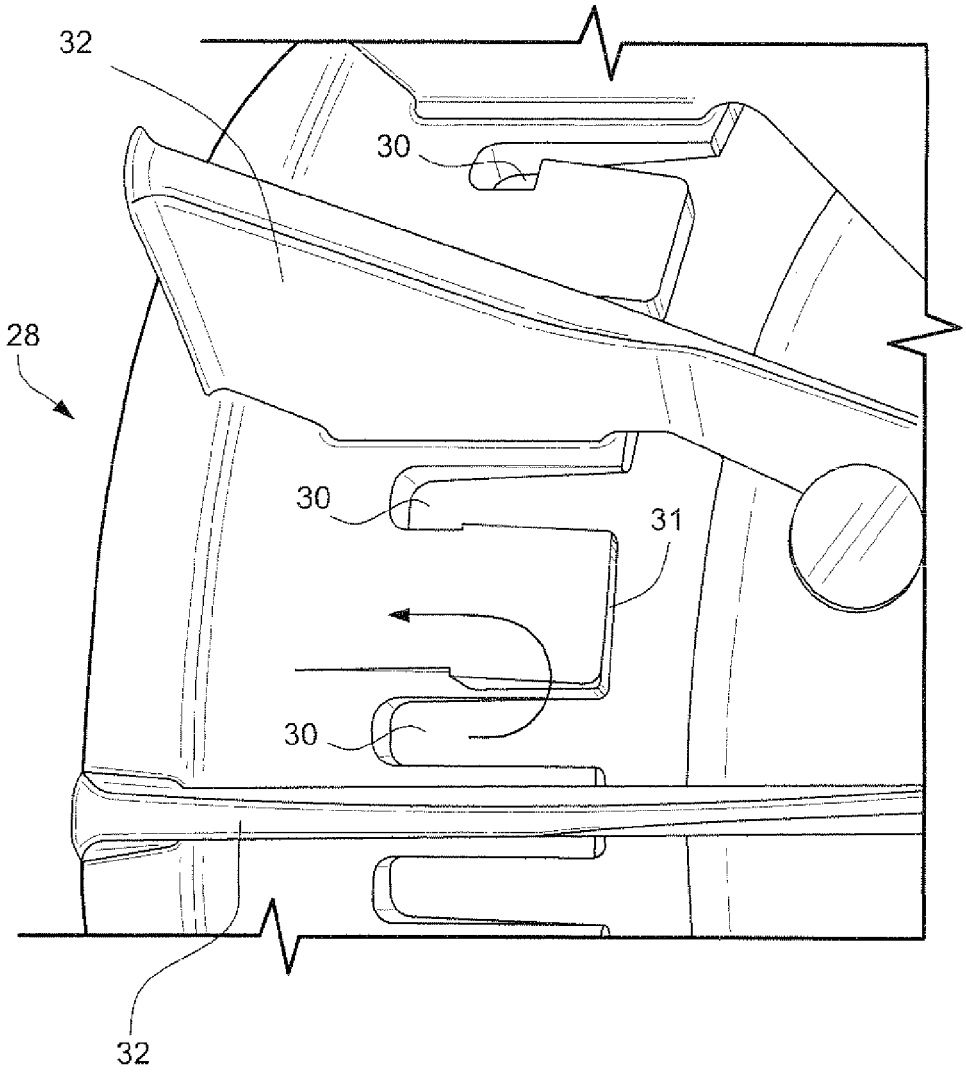
FIG. 2 is a partial perspective view of a modified compressor diffuser in accordance with the first exemplary embodiment of the invention.

Turning to FIG. 2, in a first exemplary but nonlimiting embodiment, a plurality of substantially axially-oriented slots 30 are formed in the aft end of the compressor casing 28 (typically referred to as the compressor diffuser), circumferentially about the diffuser, and between a series of compressor casing support struts 32. These slots enhance the reversal of flow direction of the compressor discharge air.

In this exemplary but nonlimiting embodiment, two slots 30 are provided for each combustor "can", occupying the space between pairs of radially-oriented struts 32. The slots 30 extend from openings at the downstream end or edge 31 of the diffuser in an upstream direction, thus providing additional flow path areas and an earlier radial turn for the compressor discharge air to reverse flow toward the combustors, at least in part avoiding the pinch points. By providing increased flow path area at an otherwise narrowed flow path location where the reverse flow occurs, the pressure drop at this location is reduced. It will be appreciated that other slot configurations could be employed, e.g., with one or more than two slots per can. In a variation of this slot configuration, the downstream edge of the diffuser could be made continuous, such that slots 30.

Figure 3:
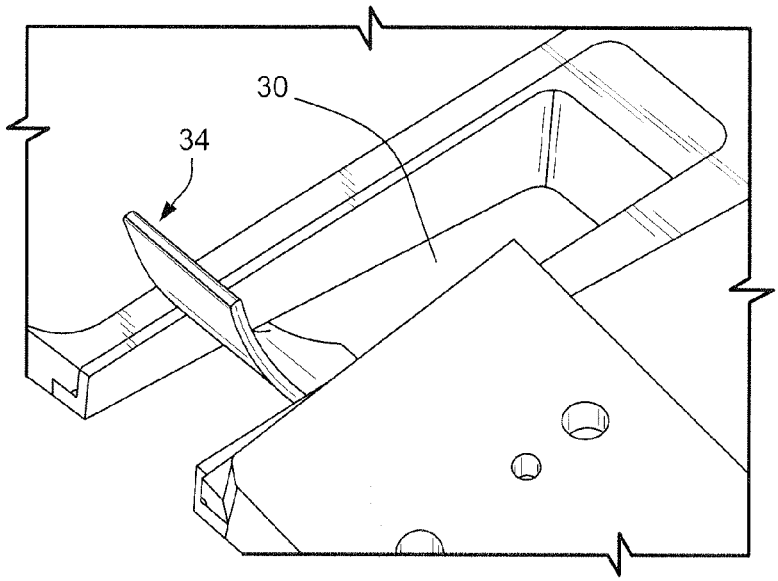
FIG. 3 is an enlarged detail in perspective taken from FIG. 2, and with a turning vane added to a slot.
Figure 4:
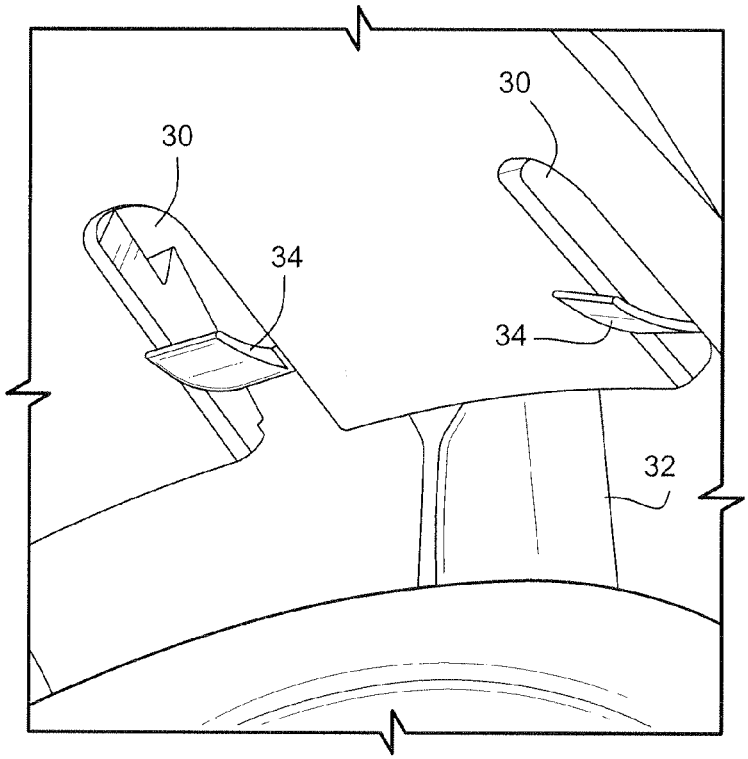
FIG. 4 is a partial perspective view of a compressor diffuser as in FIG. 3 but from below the diffuser wall.
Figure 5:
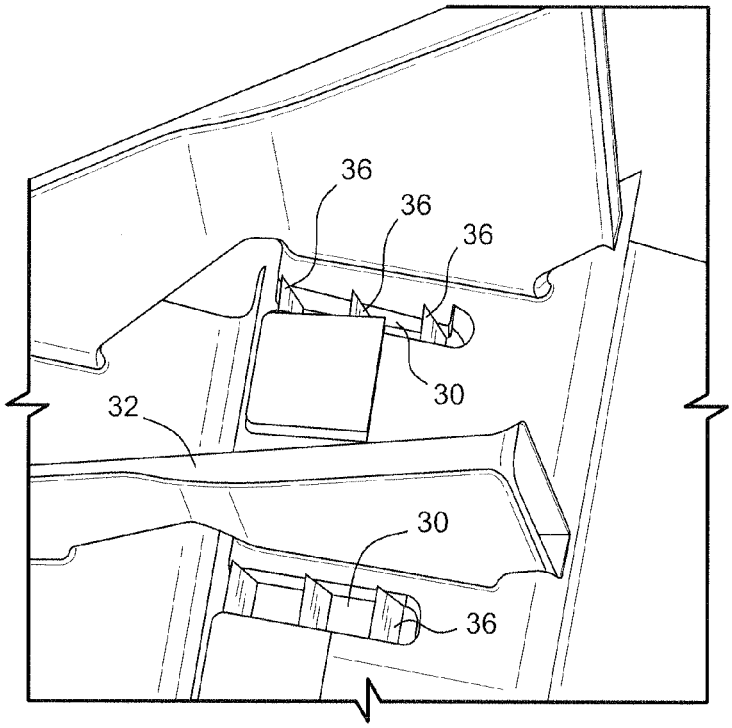
FIG. 5 is a partial perspective view of a third exemplary embodiment of the invention.
Figure 6:
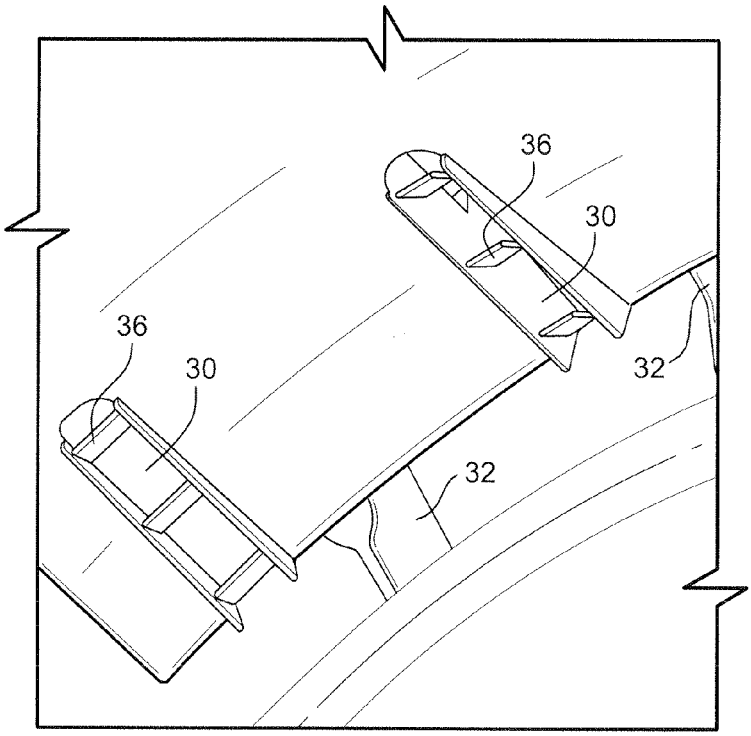
FIG. 6 is a partial perspective view taken from the underside of the diffuser shown in of FIG. 5.

A further air flow turning enhancement can be realized by adding a deflector vane 34 in each slot 30. This arrangement is shown in FIG. 3, where a single vane 34 is installed within the slot 30 and oriented to aid in turning the air flowing into the slot. i.e., with its concave side facing the flow. The vane 34 extends on both sides of the slot (see FIG. 4) so as to be impinged upon by air flowing through the diffuser, while continuing to have a turning effect as the air passes through the diffuser wall. Note that in FIG. 3, the compressor orientation is reversed, so that air flow is reversed relative to FIGS. 1 and 2. Variations in the number of vanes per slot are also possible. For example, FIGS. 5 and 6 show an arrangement where three similarly oriented turning vanes 36 are installed in each slot 38.

Figure 7:
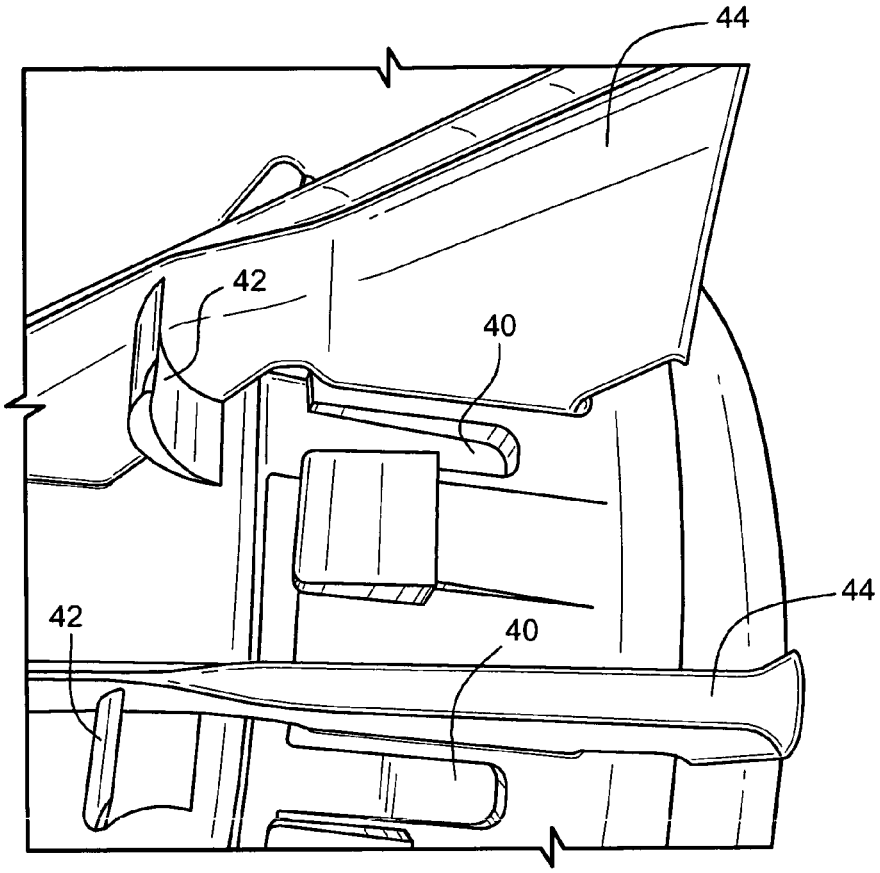
FIG. 7 is a partial perspective view of a fourth exemplary embodiment of the invention.
Figure 8:
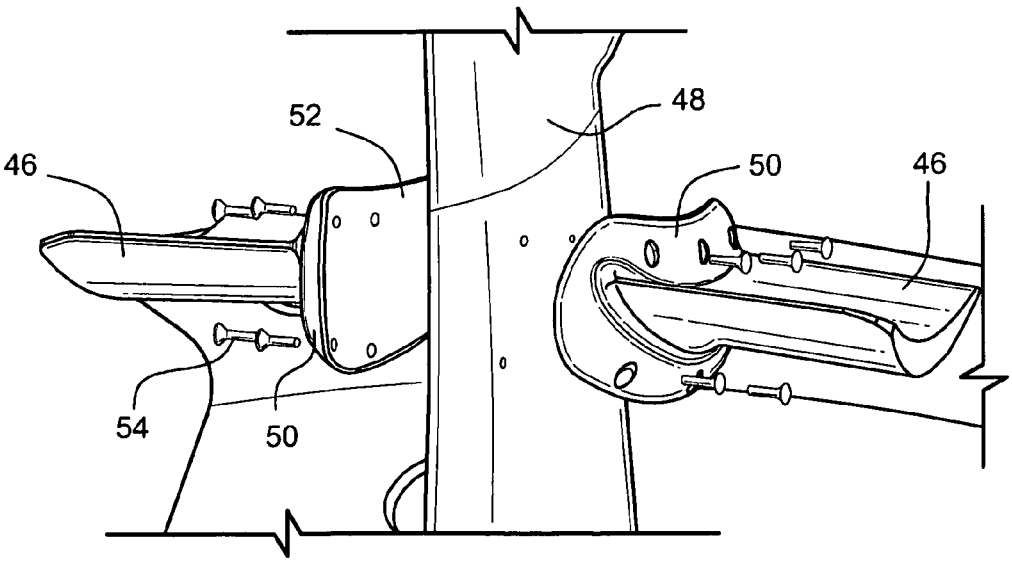
FIG. 8 is a partial perspective view illustrating how vanes can be added to the compressor discharge casing struts.

FIG. 7 illustrates a further alternative arrangement where one slot 40 is provided per can, and a turning or deflector vane 42 is installed on the nearest adjacent strut 44, downstream of the slot. FIG. 8 illustrates one example of how a pair of turning or deflector vanes 46 can be attached to opposite sides of a strut 48. Specifically, each vane 46 is provided with a mounting base 50 with a strut engaging face 52 having a surface profile matching the strut. The vanes may be attached using screw fasteners 54 or other suitable means, such as rivets or the like. As indicated above, the number of slots per can, as well as the number and location of the turning vanes may vary as needed. Presently, the preferred arrangement is to have two slots 30 per can, with one turning vane 34 per slot, either in the slot or mounted on the nearest adjacent strut 32.

In a variation of FIG. 7, the deflector vanes 46 could be utilized alone, without the slots 40. While less effective than the combination of slots and vanes, the vanes alone would nevertheless provide some enhancement of air flow reversal.

The diffuser modifications described herein can be performed in the field on existing turbine engines, or in the factory, providing performance improvement to both services customers and new unit customers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A compressor diffuser for a gas turbine comprising a casing for directing compressor discharge air to one or more combustors, said casing having an upstream end and a downstream end, the downstream end of said casing defined by a peripheral annular edge, said peripheral annular edge formed with a plurality of substantially axially-oriented slots extending from an opening at said peripheral annular edge in an upstream direction to thereby increase flow path area for compressor discharge air exiting said casing, wherein one or more of said plurality of substantially axially-oriented slots is fitted with at least one flow-directing vane for facilitating a reversal of direction of air exiting said casing, said at least one flow-directing vane projecting through said slot inwardly toward a closed end of the slot and outwardly toward an open end of the slot.

2. The compressor diffuser of claim 1 wherein said downstream end is provided with a plurality of radially outwardly extending support struts, wherein each of said plurality of substantially axially-oriented slots lies adjacent one of said support struts.

3. The compressor diffuser of claim 2 wherein one or more struts is provided with a flow-direction vane in substantially axial alignment with a corresponding one of said substantially axially-oriented slot.

4. The compressor diffuser of claim 1 wherein said at least one flow-directing vane comprises at least two flow directing vanes.

5. The compressor diffuser of claim 2 wherein between each pair of said plurality of support struts, there are two of said substantially axially-oriented slots.

6. The compressor diffuser of claim 1 wherein each flow-directing vane presents a concave surface to air flow from the compressor, such that the air flow is turned substantially 180°.

7. The compressor diffuser of claim 6 wherein each flow directing vane projects above and below a corresponding one of said substantially axially-oriented slots.

8. The compressor diffuser of claim 6 wherein each flow-directing vane is located axially closer to said annular edge than to an upstream end of a corresponding one of said substantially axially-oriented slots.

9. The compressor diffuser of claim 5 wherein each of said two substantially axially-oriented slots is provided with a single turning vane.

10. A gas turbine comprising a compressor, an annular array of combustor cans arranged to supply combustion gases to a first stage of the turbine in a first direction, wherein said compressor includes a diffuser shaped to direct compressor discharge air in a second opposite direction to an aft end of said combustor cans for use in combustion; said diffuser having an upstream end and a downstream end, the downstream end defined by an annular peripheral edge formed with a plurality of circumferentially-spaced, substantially axially-oriented slots, wherein one or more of said plurality of circumferentially-spaced, substantially axially-oriented slots is associated with at least one flow-directing vane, aligned with an open end of the slot and projecting outward away from the slot.

11. The gas turbine of claim 10 wherein said downstream end is provided with a plurality of radially outwardly extending support struts, wherein each of said plurality of substantially axially-oriented slots lies adjacent one of said support struts.

12. The gas turbine of claim 11 wherein one or more of said struts is provided with a flow-direction vane is supported on one of said support struts in substantially axial alignment with a corresponding one of said substantially axially-oriented slots.

13. The gas turbine of claim 10 wherein said at least one flow-directing vane comprises at least two flow directing vanes.

14. The gas turbine of claim 11 wherein between each pair of said plurality support struts, there are two of said circumferentially-spaced, substantially axially-oriented slots.

15. The gas turbine of claim 10 wherein each flow-directing vane presents a concave surface to air flow from the compressor, such that the air flow is turned substantially 180°.

16. The gas turbine of claim 15 wherein each flow directing vane projects above and below a corresponding one of said circumferentially-spaced, substantially axially-oriented slots.

17. A gas turbine comprising a compressor, an annular array of combustor cans arranged to supply combustion gases to a first stage of the turbine in a first direction, wherein said compressor includes a diffuser shaped to direct compressor discharge air in a second opposite direction to an aft end of said combustor cans for use in combustion;

said diffuser having an upstream end and a downstream end defined by an annular peripheral edge; and means located within said annular peripheral edge for enhancing reversal of compressor discharge air from said first direction to said second direction.

18. A method for enhancing air flow reversal in a gas turbine combustion system where compressor discharge air is reverse-flowed to a combustor comprising:

forming a downstream annular peripheral edge of a compressor diffuser with a plurality of substantially axially-oriented slots extending from a downstream end of said diffuser in an upstream direction; and associating at least one flow direction vane with one or more of said substantially axially-oriented slots, said at least one flow directing vane projecting through said slot inwardly toward a closed end of the slot and outwardly toward an open end of the slot.

* * * * *